United States Patent [19]

Koller et al.

[11] 4,233,028

[45] Nov. 11, 1980

[54] PROCESS FOR THE LEVEL DYEING OF POLYACRYLONITRILE MATERIALS OF SLOW, NORMAL AND RAPID ABSORPTIVE CAPACITY

[75] Inventors: Josef Koller, Reinach; Ulrich Horn, Basel; Peter Moser, Binningen; Manfred Motter, Aesch, all of Switzerland; Pierre Galafassi, Rixheim, France

[73] Assignee: Ciba-Geigy Corporation, Ardsley, N.Y.

[21] Appl. No.: 871,918

[22] Filed: Jan. 24, 1978

Related U.S. Application Data

[63] Continuation of Ser. No. 703,864, Jul. 9, 1976, abandoned.

[30] Foreign Application Priority Data

Jul. 14, 1975 [CH] Switzerland ..... 9168/75

[51] Int. Cl.[3] ..... D06P 1/41; D06P 5/00; D06P 3/76

[52] U.S. Cl. ..... 8/534; 8/603; 8/654; 8/657; 8/639; 8/644

[58] Field of Search ..... 8/172, 84, 169, 177 AB, 8/25, 26

[56] References Cited

U.S. PATENT DOCUMENTS

| | | | |
|---|---|---|---|
| 2,986,444 | 5/1961 | Rokohl et al. | 8/177 AB |
| 3,574,527 | 4/1971 | Walz et al. | 8/172 |
| 3,632,300 | 1/1972 | Komninos | 8/172 |
| 3,716,329 | 2/1973 | Komninos et al. | 8/169 |
| 3,726,641 | 4/1975 | Komninos | 8/172 |
| 3,785,768 | 1/1974 | Walz et al. | 8/169 |
| 3,806,504 | 4/1974 | Mundlos et al. | 8/177 R |
| 3,945,793 | 3/1976 | Corbishley et al. | 8/177 AB |
| 3,945,794 | 3/1976 | Rokohl et al. | 8/172 R |
| 3,957,433 | 5/1976 | Greenshields et al. | 8/172 R |
| 3,981,679 | 9/1976 | Christie et al. | 8/169 |
| 4,052,159 | 10/1977 | Fuerst et al. | 8/172 A |

FOREIGN PATENT DOCUMENTS

| | | | |
|---|---|---|---|
| 1146031 | 3/1963 | Fed. Rep. of Germany | 8/177 AB |
| 1160818 | 1/1964 | Fed. Rep. of Germany | 8/177 AB |
| 76750 | 12/1970 | Fed. Rep. of Germany | 8/177 AB |

*Primary Examiner*—Joseph L. Schofer
*Assistant Examiner*—Maria S. Tungol
*Attorney, Agent, or Firm*—Edward McC. Roberts

[57] ABSTRACT

Described is a process for the level dyeing of polyacrylonitrile materials of slow, normal and rapid absorptive capacity with an aqueous dye liquor, which process comprises using a liquor containing at least one migrating cationic dye as well as, if required, further additives; and adding to the liquor, before, during or after dyeing, at least one organic cationic migration auxiliary.

This process renders possible by the use of organic migration auxiliaries the obtainment of level single-shade and, in particular, combination-shade dyeings at normal dyeing temperatures.

Particularly suitable migrating cationic dyestuffs are those having a more or less delocalized positive charge, the cation weight of which dyestuffs is smaller than 310, the parachor smaller than 750 and the log P (relative lipophil property) smaller than 3.6.

Particularly suitable organic migration auxiliaries are those of which the cation weight is smaller than 250, the parachor smaller than 700 and the log P smaller than 6.4.

21 Claims, No Drawings

PROCESS FOR THE LEVEL DYEING OF POLYACRYLONITRILE MATERIALS OF SLOW, NORMAL AND RAPID ABSORPTIVE CAPACITY

This is a continuation of application Ser. No. 703,864 filed on July 9, 1976, now abandoned.

The invention relates to a process for the level dyeing of polyacrylonitrile materials of varying substantivity, to the liquor for carrying out this process, as well as to the polyacrylonitrile material dyed by the process.

The cationic dyes specially developed for dyeing polyacrylonitrile fibres are characterised in general by very good substantivity and build-up properties, by a high level of fastness as well as by a brilliant shade of colour. On the other hand, their migration capacity on most substrates made from polyacrylonitrile fibre material, such as Orlon 42, at boiling temperature (98° to 100° C.) is low. The result of this is that unevenness, which occurs as a result of the high rate of absorption of these dyes during the absorption process, can be eliminated only under conditions that run counter to the productivity of the dyeing works or to the maintenance of quality of the textile article, e.g. conditions such as a lengthening of the boiling phase or an appreciable raising of the dyeing temperature.

With the aim of avoiding these difficulties, there have been developed various dyeing processes which all have, however, the disadvantage that they have to be adapted to suit the type of polyacrylonitrile fibre, the make-up form of the material, the conditions with respect to apparatus, the rate of absorption of the employed dyes as well as the depth of shade. The object of these processes is to extend the absorption process, either by slow heating or by the addition of considerable amounts of cationic or anionic retarders. Preference is usually given in practice to a combination of these two possibilities.

For the dyeing of polyacrylonitrile materials, there are also known processes in which dyeing is performed in the presence of quaternary ammonium salts as levelling agents. These processes too do not always give satisfactory results.

The Swiss Patent Application No. 14465/74 describes a dyeing process which enables polyacrylonitrile materials having different rates of absorption, i.e. polyacrylonitrile material of rapid, slow and normal absorptive capacity, to be dyed in a simple manner with a uniform procedure. This process is characterised in that there are used at least one migrating cationic dye, at least one inorganic electrolyte, as well as, if required, migrating cationic retarders.

This process renders possible the level dyeing of all fibre types of polyacrylonitrile materials by one and the same dyeing method. Dyeings which nevertheless have turned out uneven can be easily levelled out by extended boiling. The time in which the dye bath is heated can be noticeably reduced and, finally, either no addition or for the obtainment of light shades, merely a minute addition of a retarder is necessary.

It has now been found that this process can be improved by adding to the dye bath, instead of an inorganic electrolyte, an organic cationic migration auxiliary. The levelness of dyeings is in many cases enhanced as a result; and, most important, there occurs less contamination of the environment since the organic migration auxiliaries are added in amounts that are lower than the amounts of electrolyte hitherto used, and are more easily removed from the waste-liquors, e.g. by adsorption onto suitable materials.

The present invention thus relates to a process for the level dyeing of all polyacrylonitrile materials, in the widest variety of shades, and is characterised in that there is used for dyeing polyacrylonitrile materials of slow, normal and rapid absorptive capacity an aqueous dye liquor containing at least one migrating cationic dye as well as, if required, further additives; and in that there is added to the liquor, before, during or after dyeing, at least one organic cationic migration auxiliary.

The process of the invention is preferably carried out by using for dyeing an aqueous liquor containing at least one migrating cationic dye, at least one organic cationic migration auxiliary as well as, if required, further additives.

Dyeing can however also be performed with a liquor which contains at least one migrating cationic dye as well as, if required, further additives, but no organic migration auxiliary. The dyeing is subsequently levelled out by the dyed material being treated at elevated temperature in a bath containing at least one organic cationic migration auxiliary. It is for example possible to simply add the migration auxiliary to the dye liquor subsequent to dyeing, and to further treat the dyed material in this liquor.

According to definition, the cationic dyes usable in the process of the invention must possess a migration capacity. Such dyes are described in the Swiss Patent Application No. 14465/74.

Particularly suitable migrating cationic dyes are those having a more or less delocalised positive charge, the cation weight of which dyes is smaller than 310, the parachor smaller than 750 and the log P smaller than 3.6. The parachor is calculated according to the article of O. R. Quayle [Chem. Rev. 53, 439 (1953)] and log P represents the relative lipophil property, the calculation of which has been described by C. Hansch et al [J. Med. Chem. 16, 1207 (1973)]. The effect of the charge of the dye cations was not taken into account, with the result that the log P values obtained are about 6 log units higher than those determined experimentally. In the case of protonised organic migration auxiliaries, the calculated log P values are, as a consequence of the charge effect not having been taken into account, about 4–5 log units higher than the values determined experimentally. In the present application, however, the values given for log P are in every case the calculated values.

Migrating cationic dyes that are especially suitable are those of which the cation weight is smaller than 275, the parachor smaller than 680 and the log P smaller than 2.8.

These dyes can belong to various classes. They are in particular salts, for example chlorides, sulphates, onium chlorides, fluoroborates or metal halides, for example zinc chloride salts of azo dyes, such as monoazo dyes or hydrazone dyes, diphenylmethane, methine or azomethine dyes, ketoneimine, cyanine, azine, oxazine or thiazine dyes.

Particularly good results are obtained with the use of the yellow dye of formula I

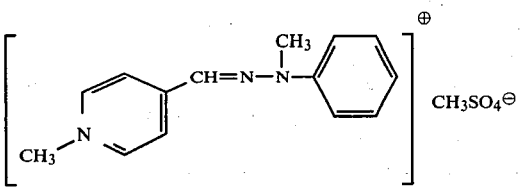

(I)

having a cation weight of 226, a parachor of 558 and a log P of 2.49; the red dye of formula II

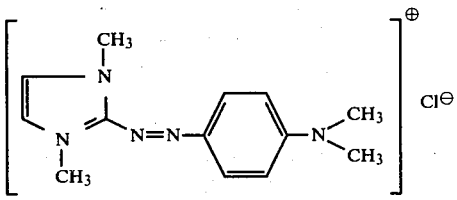

(II)

having a cation weight of 244, a parachor of 610 and a log P of 1.6; and the blue dye of formula III

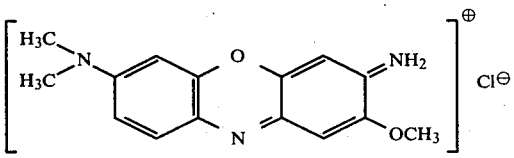

(III)

having a cation weight of 270, a parachor of 577 and a log P of 1.4.

Suitable organic migration auxiliaries are cationic organic compounds which have only a slight retarding action.

Particularly suitable organic migration auxiliaries are those of which the cation weight is smaller than 250, the parachor smaller than 700 and the log P smaller than 6.4. Preferably used amongst these are those of which the cation weight is between 100 and 200, the parachor smaller than 620 and the log P smaller than 5.4. Such migration auxiliaries usable according to the invention are, e.g., organic ammonium compounds of the general formula IV

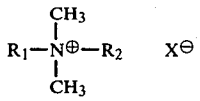

(IV)

wherein $R_1$ represents a lower aliphatic alkyl or cycloalkyl group having a maximum of 7 carbon atoms which is optionally substituted by hydroxyl groups, or a benzyl group optionally substituted by halogen or by a lower alkyl or alkoxy group, preferably the methyl group, $R_2$ represents an aliphatic straight-chain or branched-chain alkyl group having a maximum of 12 carbon atoms which optionally contains hydroxyl or epoxy groups, or a benzyl group optionally substituted by halogen or by a lower alkyl or alkoxy group, and $X^-$ represents the anion of an organic or inorganic acid.

Especially suitable among these compounds is the compound $(CH_3)_3N^+—C_6H_{13}\ Cl^-$ having a cation weight of 144, a parachor of 426 and a log P of 3.68.

Further compounds that can be used are those of the general formula V

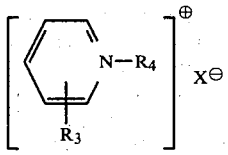

(V)

wherein $R_3$ represents hydrogen, the methyl or ethyl group, $R_4$ represents a phenyl group, or an alkyl group having a maximum of 12 carbon atoms, both optionally substituted by hydroxyl groups, or a benzyl group optionally substituted by halogen or by a lower alkyl or alkoxy group, and $X^-$ represents the anion of an organic or inorganic acid.

A particularly suitable compound amongst these is that of the formula

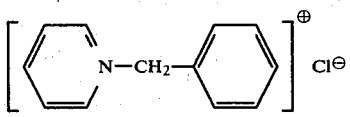

having a cation weight of 170, a parachor of 430 and a log P of 2.72; as well as the compound of the formula

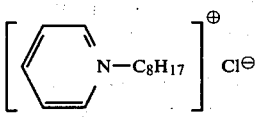

having a cation weight of 192, a parachor of 534 and a log P of 4.32.

Likewise suitable are cationic compounds of formula VI

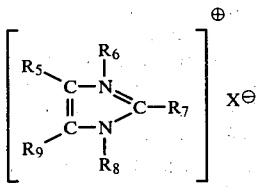

(VI)

wherein $R_5$ and $R_9$ represent hydrogen or a lower alkyl group, or together with the carbon atoms binding them form a benzene ring optionally substituted by halogen or by a lower alkyl or alkoxy group, and $R_6$ represents hydrogen or a lower alkyl group, $R_8$ represents hydrogen, or a lower alkyl group optionally substituted by a hydroxyl or phenyl group, $R_7$ represents hydrogen, a phenyl group optionally substituted by halogen or by a lower alkyl or alkoxy group, or an alkyl group having a maximum of 10 carbon atoms which is bound directly or by way of an —S— bridge, and $X^-$ represents the anion of an organic or inorganic acid.

Particularly suitable is the compound of the formula

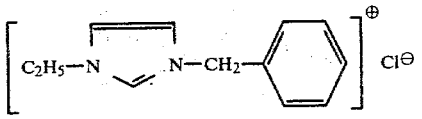

having a cation weight of 187, a parachor of 515 and a log P of 2.68.

Also suitable are compounds of formula VII

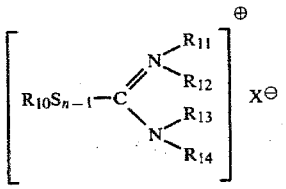

(VII)

wherein $R_{11}$, $R_{12}$, $R_{13}$ and $R_{14}$ can each represent hydrogen, a lower alkyl group, or an alkylene group which binds the two nitrogen atoms together with the adjacent carbon atom to form a 5-, 6- or 7-membered ring, $R_{10}$ can represent an aliphatic alkyl group having a maximum of 12 carbon atoms, or a phenyl radical optionally substituted by halogen or a lower alkyl or alkoxy group, $X^-$ can represent the anion of an organic or inorganic acid, and n can represent 1 or 2.

Particularly suitable is the compound of the formula

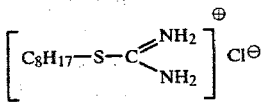

having a cation weight of 189, a parachor of 498 and a log P of 1.85.

The amounts in which the dyes usable according to the invention can be used in the dye baths can vary within wide limits depending on the desired depth of colour; in general, amounts of dye of 0.01 to 5, preferably 0.01 to 2, per cent by weight, relative to the weight of polyacrylonitrile material have proved advantageous.

The migration auxiliaries are used in amounts of 0.1 to 5, preferably 0.5 to 3, per cent by weight, relative to the weight of polyacrylonitrile material.

Also mixtures containing two or more of the migration auxiliaries can be used in the process according to the invention.

There can also be present in the dye liquor further additives customary in dyeing, such as formic acid, acetic acid or sulphuric acid, as well as compounds necessary for stabilisation of a specific pH value, e.g. sodium acetate, potassium acetate or ammonium acetate, sodium citrate, potassium citrate or ammonium citrate, sodium phosphate, potassium phosphate or ammonium phosphate.

The dye bath can in certain cases, especially for dyeing in light shades or for shading near to the boiling temperature, also contain small amounts of a migrating cationic retarder.

The process of the invention, which process has the great advantage that it does not have to be adapted to suit a specific type of polyacrylonitrile fibre, since it is applicable to all types, is performed preferably by the exhaust method. By virtue of the very good migration of the dyes as a result of the use of the migration auxiliaries, as has been emphasised, a certain unevenness in the absorption of the dyes, arising, e.g., from a greatly shortened heating phase, is quite acceptable. But the unevenness occurring in the process must be only of such a degree that it can be levelled out at the normal dyeing temperature (98°/100° C.) as well as during a normal boiling period (45 to 60 minutes).

To carry out the process according to the invention, the polyacrylonitrile material to be dyed is introduced at a temperature of about 80° C. into the dye bath containing the necessary additives; the bath is heated within 15 to 30 minutes to 98° to 100° C., maintained for 45 to 60 minutes at this temperature and then cooled. It is however also possible to heat the dye bath within 15 to 30 minutes to a temperature of 105° C. (high-temperature dyeing) and to then hold it at this temperature for 15 to 45 minutes; or to introduce the material at the boiling temperature and to dye for 30 to 60 minutes at this temperature before cooling the dye bath. It is however in general possible to carry out all conceivable variations with regard to dyeing processes.

Dyeing can however be firstly performed from a liquor not containing a migration auxiliary, and the dyeing is subsequently levelled out by treatment of the material for 30 to 90, preferably 45 to 70, minutes at 90° to 105° C. in a liquor which contains at least one organic migration auxiliary.

As mentioned, the process of the invention can be applied to all types of fibres of polyacrylonitrile, i.e. to rapidly-absorbing, normally-absorbing and slowly-absorbing polyacrylonitrile fibres. Rapidly-absorbing polyacrylonitrile fibres are, e.g., EUROACRIL®, BESLON®, CASHMILON®, EXLAN DK®, TORAYLONG FH®.

Normally-absorbing polyacrylonitrile fibres are, e.g., COURTELLE®, ACRILAN 16®, LEACRYL 16®, MALON®, etc.

Slowly-absorbing polyacrylonitrile fibres are, e.g., CRYLOR 20®, CRYLOR 50®, ORLON 42®, DRALON®, etc.

The polyacrylonitrile fibres consist principally of about 85% of an acrylic constituent and about 15% of a copolymer constituent.

The varying rate of absorption of the different types of polyacrylonitrile fibres is very closely associated with the respective glass transition point (GTP). The lower the glass transition point the higher is the absorption rate of a fibre and vice versa. The migration follows the same rules. It moreover increases greatly with rising temperature. At a given dyeing temperature, the dyestuffs migrate onto rapidly-absorbing fibres about four times more rapidly than onto slowly-absorbing fibres.

The make-up form of these polyacrylonitrile fibre materials can be extremely varied; for example, suitable forms are: loose material, combed sliver, cable, yarn as hank, cheeses, warp beam, muffs, rocket bobbins, wound packages, woven goods and knitwear and carpets.

The liquor ratio (ratio of kg of material to liters of liquor) is dependent on conditions with respect to equipment, on the substrate and on the make-up of the material, as well as on the packing density. It varies within wide limits, but is in most cases between 1:5 and 1:40.

The process according to the invention thus renders possible by the use of organic migration auxiliaries the obtainment of level single-shade and, in particular, combination-shade dyeings at normal dyeing temperatures, with the use of selected migrating cationic dyes. It constitutes a simple dyeing process which is independent of the type of polyacrylonitrile fibre to be dyed, in which process the heating-up times required are shorter than those necessary with the use of non-migrating cationic dyes, with nevertheless completely level dyeings being produced. No retarder is generally required and the process is environmentally favourable since no inorganic electrolytes need by used. It makes possible a simple repairing of dyeings which, in spite of everything, have turned out uneven, and enables, in particular, shading-off at boiling temperature to be effected. The process is specially suitable for the obtainment of the most light to medium shades.

The dyeings obtained are characterised by good fastness properties such as, in particular, fastness to light, fastness to wet processing, such as to washing, to water and to perspiration, and fastness to decatising.

The cross sections of fibres dyed by the process of the invention exhibit a perfect dye penetration, a condition which explains the absolutely level appearance of the dyeing.

The following Examples illustrate the invention without its scope being limited to them. Temperatures are given in degrees Centigrade and percentages are percentages by weight, relative to the weight of the fibre material. In the case of the dyes and migration auxiliaries, the symbols have the following meanings: K=cation weight, Pa=parachor and log P=relative lipophil property. The given amounts of dye relate to undiluted material.

EXAMPLE 1

100 g of Dralon high-bulk yarn is shrunk for 5 minutes at 80° C., in a laboratory yarn-dyeing machine, in 4 liters of an aqueous dye liquor containing 2% of acetic acid (80%), 1% of cristallised sodium acetate, 1.5% of the migration auxiliary of the formula (K 170, Pa 430, log P 2.72)

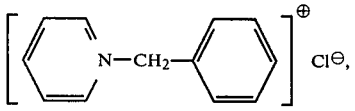

0.0235% of the yellow dye of formula I (K 226, Pa 558, log P 2.49),

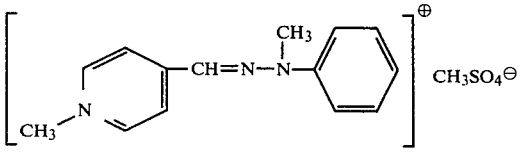

(I), 0.0135% of the red dye of formula II (K 244, Pa 610, log P 1.6)

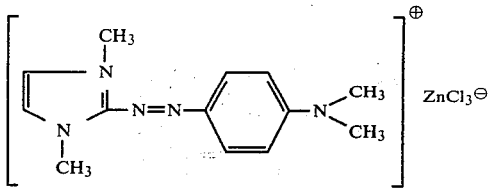

(II)

and 0.0135% of the blue dye of formula III (K 270, Pa 577, log P 1.4).

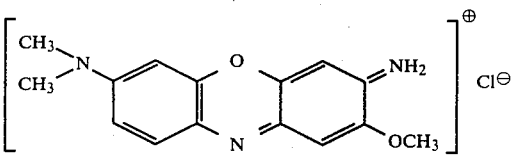

(III).

The temperature is subsequently raised within 20 minutes to 98°/100° C., and dyeing is performed for 60 minutes at this temperature. The bath is then cooled and the material is rinsed, centrifuged and dried. There is obtained a completely level light-grey dyeing.

If an inorganic electrolyte, such as sodium chloride, sodium sulphate, sodium nitrate, potassium chloride, potassium sulphate, ammonium chloride or ammonium sulphate, is employed instead of the above organic migration auxiliary, then it is necessary to use appreciably more electrolyte in order to obtain an equivalent dyeing result (at least 5%, preferably however 10%, of the weight of material). Furthermore, an addition of 0.1 to 0.5 percent by weight of a migrating cationic retarder having a parachor of between 650 and 750 is necessary in the case of light dyeings. The use of a conventional, non-migrating cationic retarder having a cationic weight greater than 310 and a parachor greater than 800, instead of the organic migration auxiliary given in this Example, results moreover in a considerable reduction of the extent of dye migration, as a consequence of which a complete equalisation of the absorption unevenness occurring as a result of rapid heating-up can no longer be achieved.

EXAMPLE 2

15 g of pre-shrunk Orlon 42-staple fabric is treated for 5 minutes at 80° C., in a Pretema dyeing machine, in 300 ml of a dye liquor containing 3% of acetic acid (40%), 0.9% of the migration auxiliary of the formula (K 187, Pa 515, log P 2.68)

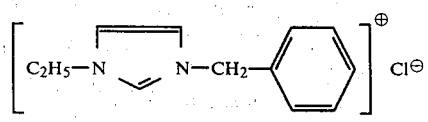

0.65% of the yellow dye of formula I, 0.4% of the scarlet red dye of the formula (K 230, Pa 574, log P 0.92)

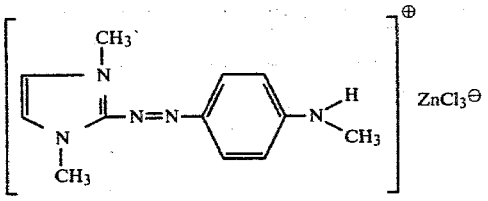

and 0.11% of the blue dye of formula III. The temperature is subsequently raised in the course of 20 minutes to 98°/100° C., and dyeing is performed for 60 minutes at this temperature. The bath is then cooled, and the material is rinsed, centrifuged and dried. There is obtained a perfectly level brown dyeing.

EXAMPLE 3

100 g of Euroacril high-bulk yarn is dyed analogously to Example 1, in a laboratory yarn-dyeing machine, using a dye combination consisting of 0.2% of the red dye of formula II and 0.12% of the violet dye of the formula (K 219, Pa 490, log P 0.59)

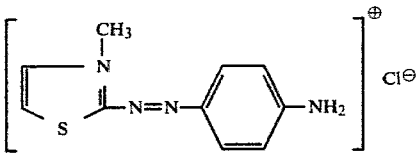

in the presence of 2% of acetic acid (80%), 1% of cryst. sodium acetate and 1.0% of the organic migration auxiliary from Example 1. There is obtained a ruby red dyeing having excellent levelness.

This dyeing was subsequently shaded in the same dyeing machine as follows: the material is firstly treated for 10 minutes at 98°-100° C. in an aqueous liquor containing 2% of acetic acid (80%) and 1% of crystallised sodium acetate. There is then added the aqueous shading additive containing 0.5% of the organic migration auxiliary of Example 1 and 0.03% of the violet dye of the above-given formula, and dyeing is performed for 30 minutes at 98°-100° C. There is obtained a shaded, perfectly level violet-dyed yarn

EXAMPLE 4

4 g of Courtelle staple fabric is dyed in an AHIBA laboratory dyeing machine by introducing the substrate at 80° C. into the dye bath containing 3% of acetic acid (40%) 3% of crystallised sodium acetate, 0.11% of the yellow dye of formula I and 0.065% of the blue dye of formula III; then heating the bath within 20 minutes to boiling; and further dyeing for 60 minutes at this temperature with a ratio of goods to liquor of 1:40. There is obtained a green but unlevel dyeing.

1.2% of the organic migration auxiliary of Example 2 is thereupon added to the dye bath, and the material is treated for a further 45 minutes at 98°-100° C. The unlevelness has completely disappeared after this treatment in the presence of the migration auxiliary, and a level dyeing in a green shade is obtained.

EXAMPLE 5

5 g of Acrilan 16 staple fabric is placed at 80° C. into an AHIBA laboratory dyeing machine containing 200 ml of an aqueous dye liquor composed of 2% of acetic acid (40%), 1.2% of the organic migration auxiliary of Example 1 and 0.4% of the yellow dye of formula I. The temperature is subsequently raised within 20 minutes to 98°-100° C. and dyeing is performed for 60 minutes at this temperature. The bath is cooled, and the fabric, faultlessly dyed in a plain-yellow shade, is rinsed, centrifuged and dried.

If there is added to the bath, instead of the yellow dye of formula I, either 0.45% of the scarlet red dye from Example 2 or 0.25% of the blue dye of formula III, with otherwise the same procedure, there is obtained in the former case a fabric dyed in a plain scarlet red shade and in the latter case a fabric dyed in a plain blue shade.

The three fabrics dyed yellow, scarlet red and blue respectively are now levelled out together in a treatment bath containing 2% of acetic acid (40%) and 2% of the organic migration auxiliary from Example 1 for 60 minutes at 105° C. with a ratio of goods to liquor of 1:40. The three dyeings that were originally plain display after levelling out a uniform brown combination shade.

Only a very slight equalisation is obtained if in the levelling out treatment the addition of the organic migration auxiliary is dispensed with.

EXAMPLES 6 to 34

Completely level light-grey dyeings are likewise obtained by using, instead of the migration auxiliary given in Example 1, identical amounts of the migration auxiliaries listed in the following Table, with the procedure otherwise being exactly as described in Example 1.

| Example | Migration auxiliary | K | Pa | log p |
|---|---|---|---|---|
| 6 | $C_8H_{17}-\overset{\oplus}{N}(CH_2CH_2OH)_2-CH_3$ $Cl^{\ominus}$ | 232 | 634 | 2,47 |
| 7 | $(CH_3)_3\overset{\oplus}{N}-$ 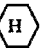 $Cl^{\ominus}$ | 142 | 379 | 3,19 |
| 8 | $(CH_3)_3\overset{\oplus}{N}-CH_2-$ 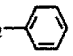 $Cl^{\ominus}$ | 150 | 402 | 3,06 |
| 9 | $(CH_3)_3\overset{\oplus}{N}-C_6H_{13}$ $Cl^{\ominus}$ | 144 | 426 | 3,68 |
| 10 | $(CH_3)_3\overset{\oplus}{N}-C_{12}H_{25}$ $Cl^{\ominus}$ | 228 | 665 | 6,68 |
| 11 | $C_6H_5-CH_2-\overset{\oplus}{N}(CH_3)_2-CH_2-C_6H_5$ $Cl^{\ominus}$ | 226 | 592 | 5,02 |
| 12 | 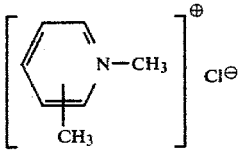 | 108 | 310 | 1,32 |
| 13 | 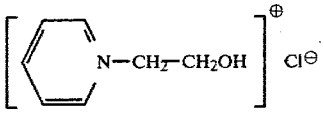 | 124 | 319 | 0,16 |
| 14 | 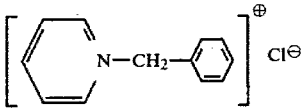 | 170 | 430 | 2,72 |

-continued

| Example | Migration auxiliary | K | Pa | log p |
|---|---|---|---|---|
| 15 | 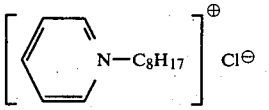 | 192 | 534 | 4,32 |
| 16 | 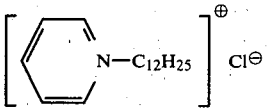 | 248 | 693 | 6,32 |
| 17 | 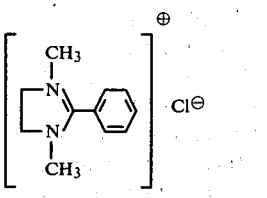 | 175 | 450 | 1,96 |
| 18 | 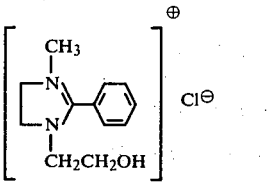 | 205 | 494 | 1,30 |
| 19 | 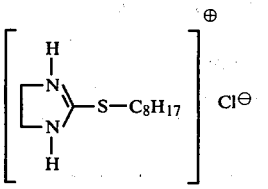 | 215 | 517 | 3,11 |
| 20 | 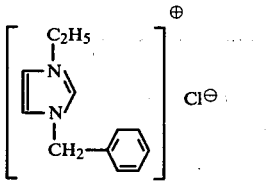 | 187 | 515 | 2,68 |
| 21 | 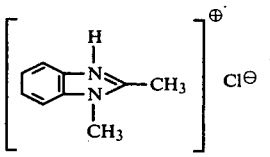 | 147 | 380 | 2,51 |
| 22 | 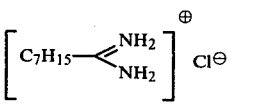 | 143 | 407 | 1,24 |
| 23 | 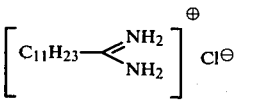 | 199 | 567 | 3,24 |
| 24 | 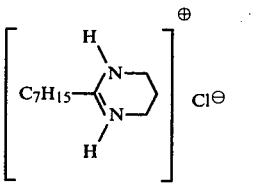 | 183 | 465 | 3,0 |
| 25 | 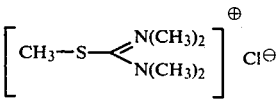 | 147 | 370 | 0,77 |

-continued

| Example | Migration auxiliary | K | Pa | log p |
|---|---|---|---|---|
| 26 | 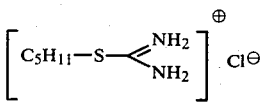 | 147 | 379 | 0,35 |
| 27 | 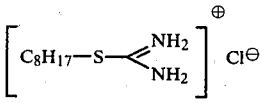 | 189 | 498 | 1,85 |
| 28 | 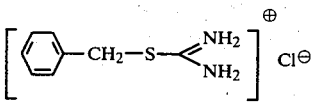 | 167 | 394 | 0,31 |
| 29 | 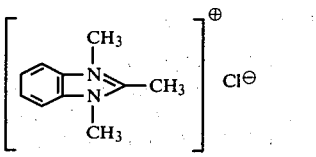 | 161 | 435 | 3,01 |
| 30 | 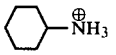 | 100 | 274 | 1,28 |
| 31 | 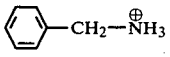 | 108 | 272 | 1,17 |
| 32 | 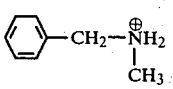 | 122 | 311 | 1,47 |
| 33 | 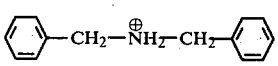 | 198 | 484 | 3,37 |
| 34 | 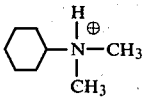 | 128 | 347 | 2,68 |

EXAMPLE 35

A completely level light-grey dyeing is likewise obtained by using, instead of the migration auxiliary given in Example 1, the same amount of a 1:1 mixture of the migration auxiliaries from the Examples 16 and 26, with the procedure otherwise being carried out exactly as described in the Example.

EXAMPLE 36

There is prepared a padding liquor of 17 parts of the yellow dye from Example 1, 10 parts of the red dye from Example 1, 10 parts of the blue dye from Example 1, 5 parts of the organic migration auxiliary from Example 1, 40 parts of 80% acetic acid, 3 parts of a locust bean flour thickener and 1000 parts of water. A fabric made from polyacrylonitrile fibres is padded in this liquor at 50° with a squeezing effect of 100%, and subsequently steamed for 45 minutes at 100° on a continuous steamer. The fabric is then well rinsed and dried. A dark grey dyeing having very good levelness and good general fastness properties is obtained.

EXAMPLE 37

6 parts of the yellow dye from Example 1, 4 parts of the blue dye from Example 1 as well as 2 parts of the migration auxiliary from Example 2 are mixed, in a high-speed stirrer, with 20 parts of thiodiglycol, 50 parts of 40% acetic acid, 450 parts of a locust bean flour derivative (12% solution) and 470 parts of boiling water. A polyacrylonitrile fabric is printed with the printing paste obtained in this manner. After being printed, the fabric is pre-dried and subsequently steamed with steam at 0.25 atm. for 20 minutes. The fabric is afterwards rinsed in a solution containing per liter of water 2 g of the condensation product of 9 moles of ethylene oxide with 1 mole of nonylphenol; it is then washed at 60° to 70°, rinsed and dried. A level green printing having good fastness properties is obtained.

We claim:

1. A process for dyeing polyacrylonitrile material in level shades, regardless of the absorptive capacity of the polyacrylonitrile material, in the absence of inorganic electrolytes, which process comprises the steps of applying to the polyacrylonitrile material an aqueous dye liquor containing at least two migrating cationic dyes having a cation-molecular weight smaller than 275, a parachor smaller than 680 and a log P smaller than 2.8, and adding to the liquor, before, during or after dyeing, at least one organic cationic migration auxiliary which is not a migrating retarder and which has a cation-molecular weight between 100 and 200, a parachor smaller than 620 and a log P smaller than 5.4.

2. Process according to claim 1, in which process there is used a migration auxiliary of formula IV

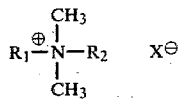

(IV)

wherein $R_1$ represents a lower aliphatic alkyl or cycloalkyl group having a maximum of 7 carbon atoms which is optionally substituted by hydroxyl groups, or a benzyl group optionally substituted by halogen or by a lower alkyl or alkoxy group, $R_2$ represents an aliphatic straight-chain or branched-chain alkyl group having a maximum of 12 carbon atoms which optionally contains hydroxyl or epoxy groups, or a benzyl group optionally substituted by halogen or by a lower alkyl or alkoxy group, and $X^{\ominus}$ represents the anion of an organic or inorganic acid.

3. Process according to claim 2, in which process there is used the migration auxiliary of the formula $$(CH_3)_3N-{}^{\oplus}C_6H_{13}\ Cl^{\ominus}$$

which has a cation-molecular weight of 144, a parachor of 426 and a log P of 3.68.

4. Process according to claim 1, in which process there is used a migration auxiliary of formula V

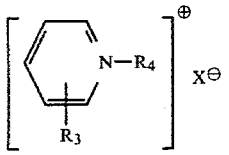

(V)

wherein $R_3$ represents hydrogen, the methyl or ethyl group, $R_4$ represents an aliphatic alkyl group having a maximum of 12 carbon atoms which is optionally substituted by hydroxyl groups, or a benzyl group optionally substituted by halogen or by a lower alkyl or alkoxy group, and $X^{\ominus}$ represents the anion of an organic or inorganic acid.

5. Process according to claim 4, in which process there is used the migration auxiliary of the formula

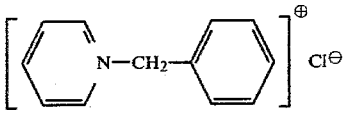

which has a cation-molecular weight of 170, a parachor of 430 and a log P of 2.72.

6. Process according to claim 4, in which process there is used the migration auxiliary of the formula

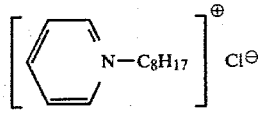

which has a cation-molecular weight of 192, a parachor of 534 and a log P of 4.32.

7. Process according to claim 1, in which process there is used a migration auxiliary of formula VI

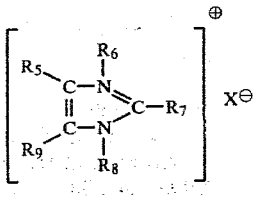

(VI)

wherein $R_5$ and $R_9$ represent hydrogen or a lower alkyl group, or together with the carbon atoms binding them form a benzene ring optionally substituted by halogen or by a lower alkyl or alkoxy group, and $R_6$ represents hydrogen or a lower alkyl group, $R_8$ represents hydrogen, or a lower alkyl group optionally substituted by a hydroxyl or phenyl group, $R_7$ represents hydrogen, a phenyl group optionally substituted by halogen or by a lower alkyl or alkoxy group, or an alkyl group having a maximum of 10 carbon atoms which is bound directly or by way of an —S— bridge, and $X^{\ominus}$ represents the anion of an organic or inorganic acid.

8. Process according to claim 7, in which process there is used the migration auxiliary of the formula

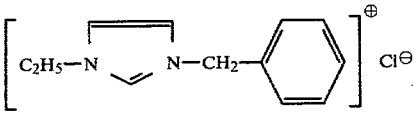

which has a cation-molecular weight of 187, a parachor of 515 and a log P of 2.68.

9. Process according to claim 1, in which process there is used a migration auxiliary of the formula VII

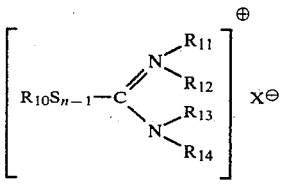

(VII)

wherein $R_{11}$, $R_{12}$, $R_{13}$ and $R_{14}$ can each represent hydrogen, a lower alkyl group, or an alkylene group which binds the two nitrogen atoms together with the adjacent carbon atom to form a 5-, 6- or 7-membered ring, $R_{10}$ can represent an aliphatic alkyl group having a maximum of 12 carbon atoms, or a phenyl radical optionally substituted by halogen or by a lower alkyl or alkoxy group, $X^{\ominus}$ can represent the anion of an organic or inorganic acid, and n is 1 or 2.

10. Process according to claim 9, in which process there is used the migration auxiliary of the formula

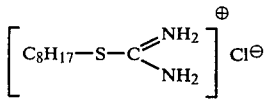

which has a cation-molecular weight of 189, a parachor of 498 and a log P of 1.85.

11. Process according to claim 1, wherein dyeing is performed by the exhaust method.

12. Process according to claim 1, wherein the material to be dyed is introduced into the dye bath at about 80° C., the bath is heated within 15 to 30 minutes to 98° to 100° C., and dyeing is performed for 45 to 60 minutes at this temperature.

13. Process according to claim 1, wherein the material to be dyed is introduced into the dye bath at about 80° C., the bath is heated within 15 to 30 minutes to 105° C., and dyeing is performed for 15 to 45 minutes at this temperature.

14. Process according to claim 1, wherein the material to be dyed is introduced into the dye bath at 95° to 100° C., and dyeing is performed for 30 to 60 minutes at this temperature.

15. The process of claim 1, wherein the organic cationic migration auxiliary is added to the liquor after dyeing, and wherein the dyed polyacrylonitrile material is levelled out by treatment at elevated temperature.

16. The process of claim 15, wherein the levelling is achieved by heating the liquor at 90° to 105° C. for 45 to 70 minutes.

17. The process of claim 1, wherein the dye liquor contains 0.01 to 5% by weight, relative to the weight of the polyacrylonitrile material, of the migrating cationic dyes.

18. The process of claim 17, wherein the weight of the migrating cationic dyes is 0.01 to 2% by weight.

19. The process of claim 1, wherein the dye liquor contains 0.1 to 5% by weight, relative to the weight of the polyacrylonitrile material, of the cationic migration auxillary.

20. The process of claim 19, wherein the weight of the cationic migration auxiliary is 0.5 to 3% by weight.

21. An aqueous dye liquor for dyeing polyacrylonitrile material in level shades, regardless of the absorptive capacity of the polyacrylonitrile material, which liquor is free of inorganic electrolytes and contains at least two migrating cationic dyes, having a cation-molecular weight smaller than 275, a parachor smaller than 680 and a log P smaller than 2.8, and at least one organic cationic migration auxillary which is not a migration retarder and which has a cation-molecular weight of 100 to 200, a parachor smaller than 620, and a log P smaller than 5.4.

* * * * *